US005108165A

United States Patent [19]

Rorke et al.

[11] Patent Number: 5,108,165

[45] Date of Patent: Apr. 28, 1992

[54] FLUSH-FRONT CABINET DOOR AND HINGE THEREFOR

[75] Inventors: A. Brooks Rorke, Fairfield, Conn.; Wallace C. Bullwinkle, Norristown, Pa.

[73] Assignee: Westinghouse Electric Corp., Pittsburgh, Pa.

[21] Appl. No.: 711,274

[22] Filed: Jun. 4, 1991

Related U.S. Application Data

[63] Continuation of Ser. No. 536,874, Jun. 12, 1990, abandoned.

[51] Int. Cl.[5] ..... A47B 88/00

[52] U.S. Cl. ..... 312/322

[58] Field of Search ..... 312/322, 323

[56] References Cited

U.S. PATENT DOCUMENTS

| | | | |
|---|---|---|---|
| 523,690 | 7/1894 | Sinclair | 312/322 X |
| 1,873,522 | 8/1932 | Abbott et al. | 312/327 X |
| 2,049,080 | 7/1936 | Pickup | 312/322 X |
| 2,750,901 | 6/1956 | McClellan | 312/214 X |
| 2,936,206 | 5/1960 | Wilmer et al. | 312/322 |
| 3,456,995 | 7/1969 | Nyquist | 312/322 |
| 4,552,212 | 8/1989 | Amann | 312/322 |
| 4,910,916 | 3/1990 | Dubach et al. | 312/322 X |
| 4,945,972 | 8/1990 | Takeuchi | 312/322 X |

*Primary Examiner*—Joseph Falk

[57] ABSTRACT

A combined slider and hinge structure for a vertical cabinet door is disclosed, which permits the cabinet door to be constructed with its hinged edge arranged flush with the side of the cabinet to which it is hinged. The inventive structure includes front and back columnar interior frame members, upper and lower slides secured to the frame members, an elongated anti-rack plate secured to the sliding members of the upper and lower slides, upper and lower flush-mount hinges secured to the anti-rack plate inwardly of and adjacent to the slides, and a door secured to the hinges. A false exterior panel can be placed over the frame members, slides, and anti-rack plate to conceal them. In operation, the door is rotated on the hinges to an open position, and thereafter the slides are operated by pushing the door directly toward the rear of the cabinet structure, retracting the door and concealing it behind the false exterior panel.

5 Claims, 2 Drawing Sheets

FLUSH-FRONT CABINET DOOR AND HINGE THEREFOR

This application is a continuation of U.S. Pat. application Ser. No. 07/536,874, filed Jun. 12, 1990.

BACKGROUND OF THE INVENTION

1. Field Of The Invention

The present invention relates generally to cabinets having hinged pocket doors which swing laterally outwardly or upwardly, and can then be recessed. The present invention specifically relates to vertical cabinets and the like having at least one slidably concealable hinged pocket door and similar apparatus enabling the hinged side of the door to be positioned flush with the side of the cabinet to which it is hinged such that the cabinet includes no side panels adjacent the front door panels.

2. Prior Art

Designers of furniture, particularly office furniture such as storage cabinets and the like, have long desired to produce an attractive and useful cabinet design incorporating cabinet doors which have hinged edges mounted flush with the sides of the cabinet to which they are hinged. In prior art cabinets, a schematic representation of which appears in FIG. 3, the cabinet 30 typically includes two vertical doors 32, i.e., doors which are hinged to pivot on a vertical axis, having conventional hinges (not shown) secured to their vertical side edges. The doors 32 are conventionally secured within a supporting framework masked or concealed by a peripheral border or "window" 33 of material such as sheet metal. For example, in the cabinet 30 shown in FIG. 3, the "window" 33 surrounding doors 32 is formed of narrow, elongated top and bottom panels 34 and 35 and elongated side panels 36. However, the presence of a "window" 33 such as shown in FIG. 3 is considered undesirable by some furniture designers, because it creates narrow, elongated channels or gaps at the points where the doors 32 and the "window" 33 meet. In the cabinet 30 of FIG. 3, a vertical channel or gap 38 exists at the point where the vertical outer edges of doors 32 meet and clear panels 36. Further, an elongated, horizontal gap 39 exists at the point where the top horizontal edges of doors 32 meet and clear panel 34. These gaps 38 and 39 are considered unsightly by many designers, because the panels interrupt the otherwise uniform surface of the doors 32, and interfere with motifs, finishes, and other materials applied to the surfaces of doors 32.

A further challenge to the furniture designer arises because many designers desire to create cabinet doors which slide into and are concealed by the cabinet superstructure when the doors are open. Certain conventional lateral files and lateral cabinets having horizontal doors, i.e., doors which are hinged to pivot on a horizontal axis, have included structures which permit the cabinet door to be lifted up and slid horizontally rearward into the cabinet structure. Such cabinets are typically referred to as pocket door cabinets, because when the door is slid into the cabinet, it is conceptually placed into a "pocket" within the cabinet structure. Prior art pocket door lateral cabinets have possessed the significant disadvantage that the pocket door is surrounded by a "window" of material which the door must clear in order to be slid into the cabinet superstructure. This window around the pocket door shares the design disadvantages discussed above in connection with the vertical door cabinet.

Thus, the prior art appears deficient in not providing a storage cabinet, door, retractable slide, and hinge structure which permits the door to be opened by rotating the door outwardly, and thereafter permits concealing the door by sliding the door rearward into the cabinet superstructure. Designers would find useful a combined cabinet door, hinge, and slide which permits the cabinet door to be concealed within the cabinet superstructure and yet uses commonly available, off-the-shelf parts for the slide and hinge.

SUMMARY OF THE INVENTION

These goals, and other objects which will become apparent from the detailed description which follows, are achieved through provision of a cabinet structure combining inside columnar front and back frames, two conventional drawer or door slides secured to the frame for each door of the cabinet, an elongated anti-rack plate secured to the sliding members of the slides, flush-opening door hinges secured to the anti-rack plate, a cabinet door secured to the movable end of the hinges, and an exterior cabinet wall which conceals the above structure but which is not secured to the inside frame. This arrangement permits construction of a cabinet door having a hinged edge arranged flush and immediately adjacent to the exterior panel of the cabinet to which it is hinged, thereby creating a finished cabinet having a contiguous, uninterrupted exterior profile.

It is therefore a primary object of the present invention to provide a cabinet door structure which permits the cabinet door to be hingedly opened by rotating the door 90°, and when the door is in a fully opened position, permits the door to be slid into the cabinet structure and concealed.

Another object of the present invention is to provide a mechanism for opening and sliding a cabinet door which permits the door, when in a closed position, to fully conceal the mechanism and the edge of the cabinet to which the door is hinged.

Still a further object of the present invention is to provide a cabinet door structure which is easily adapted to existing vertical cabinet designs and does not require a significantly greater quantity of materials for practical construction than existing hinge and door structures.

Further objects and advantages as well as the features and details of the present invention are apparent from the accompanying drawings, specification, and claims.

A better understanding of the disclosed embodiments of the invention will be achieved when the accompanying detailed description is considered in conjunction with the appended drawings, in which like reference numerals are used for the same parts as illustrated in the different figures.

BRIEF DESCRIPTION OF THE DRAWINGS

The foregoing structure of the present invention is depicted in detail in the following drawing figures.

DETAILED DESCRIPTION OF THE PREFERRED EMBODIMENTS

Figure 1:
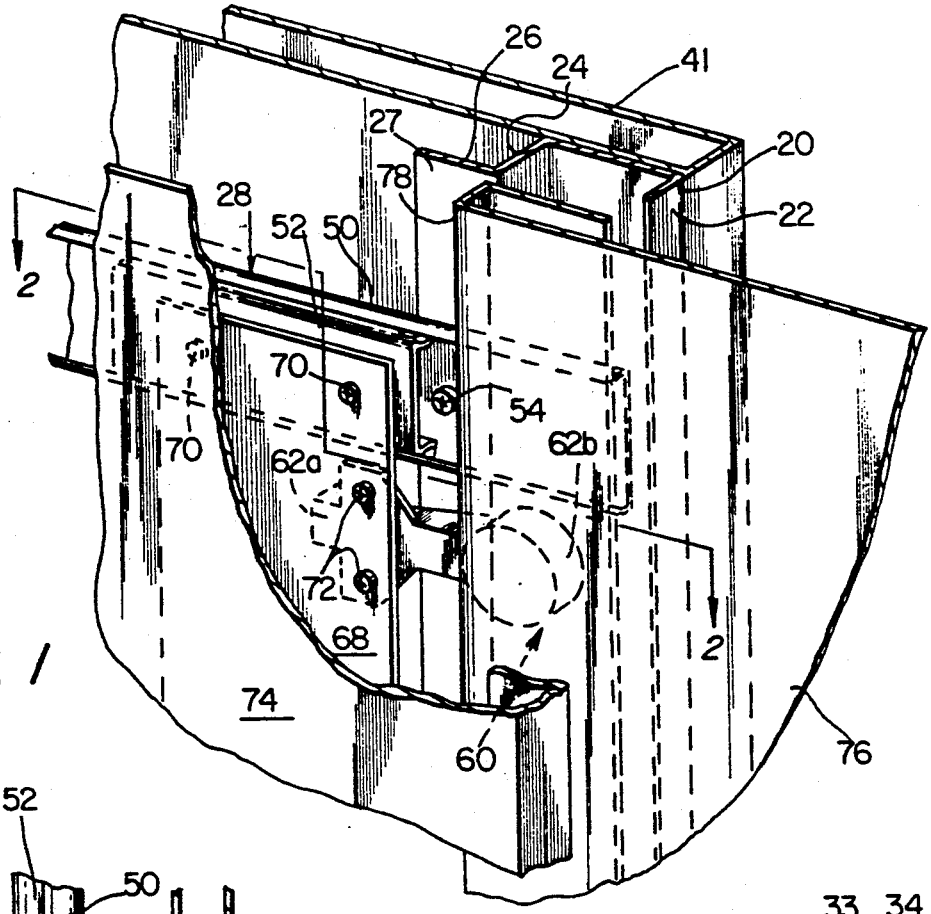
FIG. 1 is a partial perspective view of the present invention, with parts cut away, showing the cabinet wall, door, hinge, and slider.

In the following detailed description of the preferred embodiment of the present invention, specific terminology is used for the sake of clarity. However, the terminology chosen is general, and includes all technical equivalents accomplishing a substantially similar purpose by operating in a substantially similar manner.

Referring now to FIGS. 1, 2, 4, and 5, there is shown a preferred embodiment of a vertical storage cabinet 40 having two exterior vertical doors 42. Cabinet 40 is bilaterally symmetrical, i.e., doors 42 and their mounting mechanisms are mirror images of each other.

Doors 42 are hingedly secured to the cabinet superstructure along their vertical outer edges 44. Their vertical inner edges 45 are separated by an elongated vertical gap 48. Each door 42 can be provided with a conventional gripping member 46 such as a handle or knob.

Figure 2:
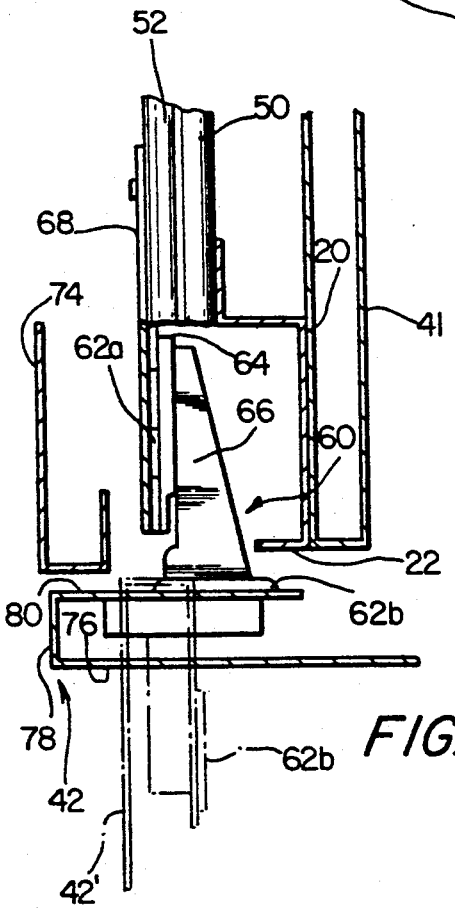
FIG. 2 is a cross-sectional view of the door hardware taken along line 2—2 of FIG. 1.
Figure 3:
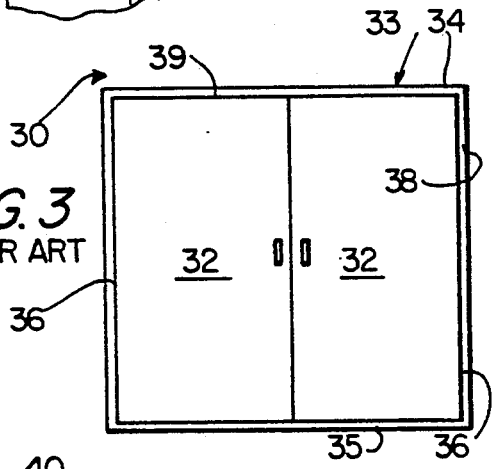
FIG. 3 PRIOR ART
FIG. 3 is a schematic front elevation representing a prior art vertical cabinet and door structure.
Figure 4:
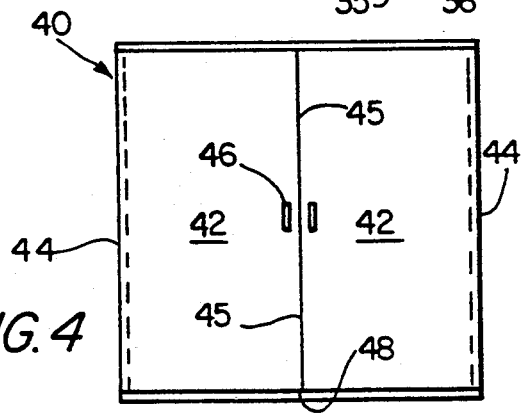
FIG. 4 is a schematic front elevation representing a vertical cabinet constructed according to the present invention.
Figure 5:
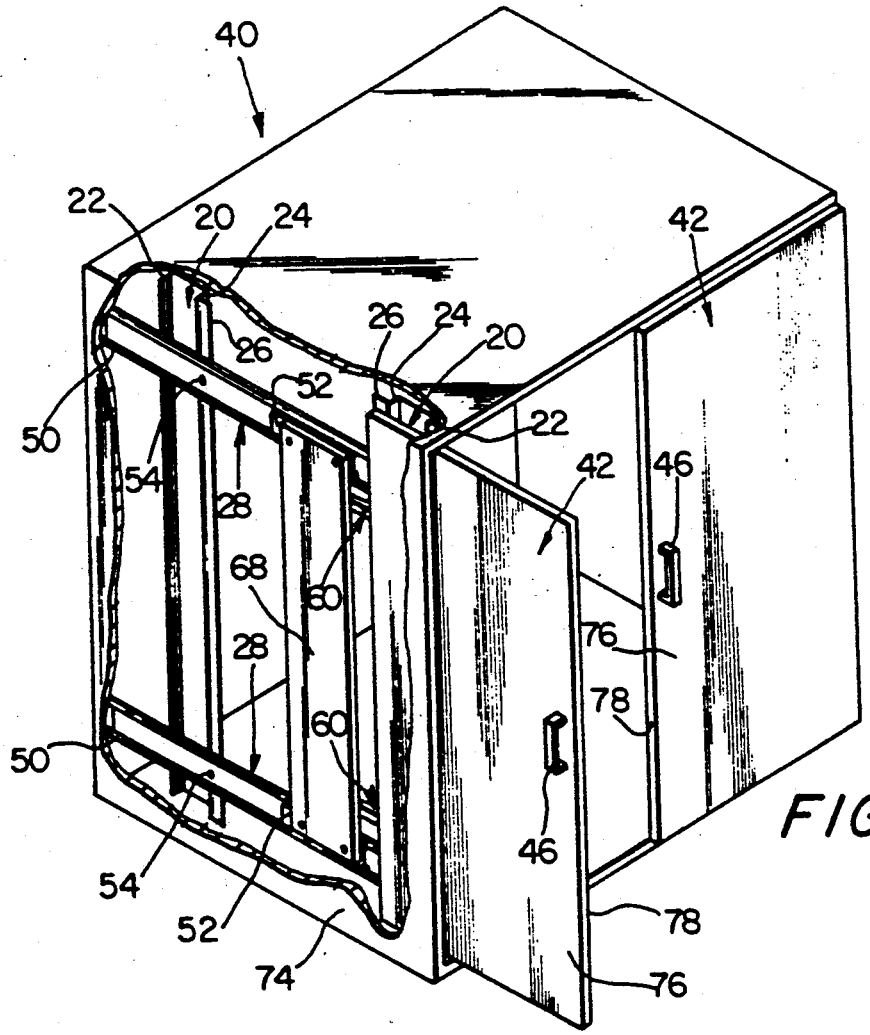
FIG. 5 is a perspective view of a cabinet using the inventive structure.
Figure 6:
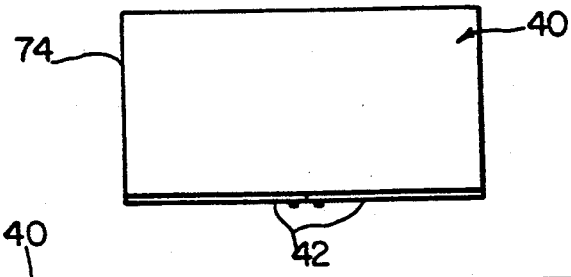
FIG. 6 is a top plan view of the cabinet of FIG. 5, with both of the doors in the closed position.
Figure 7:
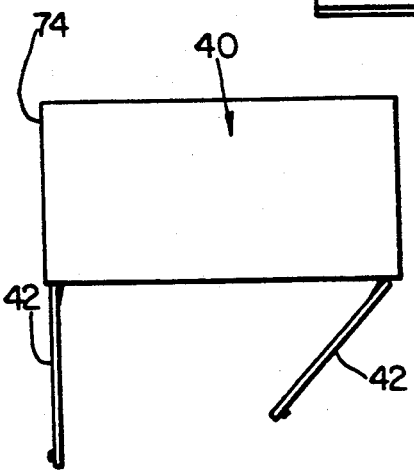
FIG. 7 is a top plan view of the cabinet of FIG. 5, with the left door in the full open position and with the right door in a partially open position.

Details of the interior structure of the door and hinge structure are shown in FIGS. 1 and 2, while the general structure is shown in FIG. 5. As FIGS. 2 and 5 show, a cabinet incorporating the door, hinge, and slide arrangement of the present invention includes parallel, spaced-apart, front and back inside vertical frame members 20 which are secured by conventional means to an inner wall 41 (FIGS. 1 and 2) of cabinet 40 and are preferably manufactured using formed or extruded metal. Each frame member 20 is a substantially "C" shaped column which extends from the base of the cabinet to its top, as shown in FIG. 5. Frame member 20 is constructed with vertical outer and inner stile members 22 and 24. The outer stile member 20 of the front frame member 20 faces outwardly and masks the interior structure of the cabinet from view when the door 42 is moved to an open position, designated 42' in FIG. 2. The inner stile member 24 has a slightly greater width than outer stile member 22. Formed unitarily at a 90° angle with respect to inner stile member 24 is a vertical rear guide rib 26. Parts 26, 24, and 22 are unitarily formed as inseparable components of frame member 20.

Parallel, spaced-apart, upper and lower slides 28 are perpendicular to frame members 20 and are secured adjacent the top and bottom of the outer face 27 of each of the guide ribs 26. The slides 28 are conventional, comprising a fixed standard 50 and a sliding member 52. The slides 28 are secured to the outer faces 27 of guide ribs 26 using conventional fasteners 54, such as a sheet metal screw or bolt.

Upper and lower slides 28 and door 42 form two of four major components of the inventive assembly. Upper and lower hinges 60 form the third major component. Hinges 60 are of conventional design and can comprise one of the 100 or 200 series of hinges manufactured by Salice America, Inc., 3301 Woodpark Boulevard, Suite P, Charlotte, N.C. 28206. Upper and lower hinges 60 are positioned inwardly of and adjacent to upper and lower slides 28. Each hinge 60 includes an inner mounting base plate 62*a* secured in a manner to be described hereinafter to slides 28, an outer mounting base plate 62*b* secured to door 42, an adjustment plate 64 secured to inner mounting base plate 62*a*, a hinge arm 66 secured to adjustment plate 64, and an extender member (not shown) securing hinge arm 66 to door 42.

To enable upper and lower hinges 60 and upper and lower slides 28 to be arranged in a vertically coplanar arrangement, the base plate 62 of each of hinges 60 is secured to the inner face of an anti-rack plate 68, which forms the fourth component of the assembly of the present invention. Each of hinges 60 is secured to the anti-rack plate 68 using plural fasteners 72. The anti-rack plate 68 is further secured to the outer face of slider member 52 using plural fasteners 70. Both fasteners 70 and 72 are conventional threaded fasteners such as sheet metal screws or bolts. The anti-rack plate 68 is an elongated rectangular plate preferably manufactured of steel, and extends from top to bottom of the cabinet 40 along nearly the entire vertical extent of doors 42. The plate 68 secures the top slide and hinge assembly to the bottom slide and hinge assembly so that both upper and lower sliding members 52 will retract into the cabinet superstructure at the same time. If an anti-rack plate 68 were not used in the present invention, then application of an inward force to the inner edge 45 of door 42 other than at the center could cause the door to slide in at an angle and jam.

The cabinet and door arrangement of the present invention also includes a cabinet exterior wall 74 which covers the frame members 20, slides 28, and anti-rack plate 68, as well as door 42 when it is in a partially or fully retracted position. The relationship of the cabinet exterior wall 74 to the hinge and slide mechanism is generally cosmetic; the exterior wall 74 does not provide significant structural support for the frame members 20 or the slides 28.

As shown in FIG. 2, the door 42 is constructed using a hollow-core design comprising an exterior wall 76, an end wall 78, and a relatively short rear wall 80. The rear wall 80 provides the surface to which the hinge member 66 is secured. Preferably walls 76, 78, and 80 are all manufactured of rigid, sheet material such as rolled sheet steel. It should be understood that the invention can also be used with a conventional solid door or a hollow-core door having exterior and interior walls of the same dimensions.

FIGS. 1 and 2 further show three different positions assumed by door 42 in operation. In FIG. 2, door 42 is shown in the closed position such that the plane of exterior wall 76 is positioned perpendicular to the plane of cabinet exterior 74 wall. In this closed position, sliding members 52 are in their forwardmost position, and hinges 60 are closed. By rotating cabinet door 42 to the open position 42', the enclosed extender members of hinges 60 are extended, and door 42 will clear the interior, outward-facing corner 76 of cabinet exterior wall 74.

Figure 8:
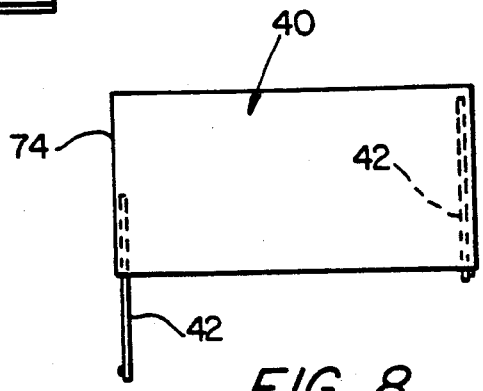
FIG. 8 a top plan view of the cabinet of FIG. 5, with the left door in a partially retracted position and the right door in a fully retracted position.

After door 42 assumes the open position shown as 42' in FIG. 2, the door 42 can be slid directly into the cabinet structure to assume a partially or fully retracted position as shown in FIG. 8. In the view shown in FIG. 1, the door 42 is partially retracted into the superstructure, such that sliding members 52 are partially retracted rearwardly in standards 50. From this position, the door 42 can be fully retracted into the cabinet structure as shown in FIG. 8 by pushing the door 42 directly back toward the rear of the cabinet 40.

From the above, it is apparent that many modifications and variations of the present invention are possible in light of the above teachings. For example, the present invention can be used with horizontal, as well as vertical doors, and can be used in cabinets having one vertical door, as well as two vertical doors. It is therefore to be understood that, within the scope of the appended claims, the invention be practiced otherwise than as specifically described.

What is claimed is:

1. An article of furniture comprising:

an inner wall having an interior surface facing the interior of said article of furniture and an exterior surface facing the exterior of said article of furniture;

an outer wall parallel to and spaced apart from said inner wall;

front and back, parallel, spaced-apart columnar frame members attached to said outer surface of said inner wall, each of said front and back frame members having a first end and a second end;

first and second parallel, spaced-apart slides, each of said slides comprising a standard and a sliding member slidably engaged in said standard, said standards of said first and second slides being secured respectively adjacent said first and second ends of said front and back frame members and being perpendicular to said front and back frame members;

an elongated anti-rack plate having first and second ends secured respectively to said sliding members of said first and second slides, an interior face facing the interior of said article of furniture, and an exterior face facing the exterior of said article of furniture, said anti-rack plate extending parallel to said frame members and perpendicular to said standards;

first and second parallel, spaced-apart hinges mounted on said inner face of said anti-rack plate, adjacent to and inwardly of said first and second standards, respectively; and a door mounted to said anti-rack plate by said first and second hinges for pivotal movement between an open and a closed position.

2. An article of furniture comprising:

first and second outer walls parallel to each other and each having an interior surface facing the interior of said article of furniture, an exterior surface facing the exterior of said article of furniture, and a front edge joining said interior and exterior surfaces;

an inner wall parallel to and intermediate said first and second outer walls, said inner wall being proximate said first outer wall and having an interior surface facing the interior of said article of furniture, an exterior surface facing the exterior of said article of furniture, and a front edge joining said interior and exterior surfaces;

a door having an interior surface facing the interior of said article of furniture, an exterior surface facing the exterior of said article of furniture, and first and second side edges joining said interior and exterior surfaces, said door being movable between a closed position in which said exterior surface overlies said front edges of said inner, outer, and intermediate walls and said first and second side edges are substantially flush with said exterior surfaces of said outer walls, an open position perpendicular to said closed position in which said door extends forwardly of said front edges of said inner, outer, and intermediate walls, and a retracted position in which said door is retracted between said inner wall and said first outer wall;

slide means for sliding said door between said open position and said retracted position;

hinge means for pivoting said door between said closed and open positions about an axis adjacent said second edge of said door, said hinge means having an outer end attached to said interior surface of said door adjacent said second edge and an inner end attached to said slide means; and frame means for attaching said slide means to said exterior surface of said inner wall in spaced relation from said exterior surface of said inner wall.

3. The article of furniture of claim 2, wherein said frame means comprises front and back, parallel, spaced-apart columnar frame members attached to said outer surface of said inner wall.

4. The article of furniture of claim 2, wherein said slide means comprises first and second parallel, spaced-apart slides, each of said slides comprising a standard and a sliding member slidable engaged in said standard, said standards of said first and second slides being secured to said frame means and being perpendicular to said front edge of said inner wall.

5. The article of furniture of claim 4, wherein said slide means further comprises an elongated anti-rack plate having first and second ends secured respectively to said sliding members of said first and second slides, an interior face facing the interior of said article of furniture, and an exterior face facing the exterior of said article of furniture, said anti-rack plate extending perpendicular to said standards.

* * * * *